US005544590A

United States Patent [19]

Summa et al.

[11] Patent Number: 5,544,590

[45] Date of Patent: Aug. 13, 1996

[54] AUTOMATIC SEAL CROSSOVER SYSTEM FOR POWER AND FREE CONVEYOR ON-FLOOR CARRIAGES

[75] Inventors: Gareth D. Summa, Denver, Mo.; Darrel Hespe, Olathe, Kans.

[73] Assignee: Mid-West Conveyor Company, Kansas City, Kans.

[21] Appl. No.: 527,956

[22] Filed: Sep. 14, 1995

[51] Int. Cl.[6] ..... B61B 10/00

[52] U.S. Cl. ..... 104/130.09

[58] Field of Search ..... 104/130.09, 130.07, 104/130.01, 130.06, 194, 306, 140, 141, 146, 172.1, 172.2, 172.3

[56] References Cited

U.S. PATENT DOCUMENTS

| | | | |
|---|---|---|---|
| 228,972 | 1/1941 | Pinder | 104/130.09 |
| 2,688,933 | 9/1954 | Spafford | 104/130.06 |
| 2,840,006 | 6/1958 | Henderson | 104/130.06 |
| 3,518,946 | 7/1970 | Kavieff . | |
| 4,516,504 | 5/1985 | Brems et al. . | |
| 4,542,698 | 9/1985 | Wakabayashi | 104/130.09 |
| 5,033,394 | 7/1991 | Summa . | |
| 5,036,773 | 8/1991 | Christen . | |

FOREIGN PATENT DOCUMENTS

| | | | |
|---|---|---|---|
| 4-85165 | 3/1992 | Japan | 104/130.06 |

*Primary Examiner*—Mark T. Le

*Attorney, Agent, or Firm*—Litman, McMahon and Brown, L.L.C.

[57] ABSTRACT

The present invention is directed to a seal crossover system which includes two seal plates adjacent to slot crossover portions of separate respective conveyor loops as they diverge (or converge) past a switch in a power and free conveyor system. The seal plates are driven by respective pneumatic cylinders which are pneumatically linked to a switch cylinder such that the seal plates are automatically extended or retracted depending upon the condition of the switch. Thus a respective slot crossover portion of each conveyor loop is selectively and alternately sealed or opened to allow unimpeded passage of a load carriage and a drive trolley, respectively.

16 Claims, 4 Drawing Sheets

AUTOMATIC SEAL CROSSOVER SYSTEM FOR POWER AND FREE CONVEYOR ON-FLOOR CARRIAGES

FIELD OF THE INVENTION

The present invention relates to an automatic seal crossover for on floor load carriages in a power and free conveyor system, and more particularly to such a seal crossover system which automatically puts a seal plates over a slot crossover portion of a selected one of two conveyor loops as they diverge (or converge) near a conveyor switch.

BACKGROUND OF THE INVENTION

Power and free conveyor systems for moving bulky items through a manufacturing or assembly plant are well known. Such power and free conveyors include a "power" and a "free" conveyor track, generally disposed vertically with respect to each other. Operating within the power track is an endless drive chain with drive dogs periodically attached to the chain and extending toward the free track. These drive dogs are oriented to engage a trolley dog or actuator on a drive trolley operating within the free track. While the drive dogs are generally fixed in position relative to the drive chain, the trolley dogs on the drive trolleys are typically selectively retractable.

The vertically spaced free track generally follows the same path as the power track(s). As originally implemented, power and free conveyor systems were suspension systems with loads suspended from trolleys or carriers operating in the free track and with the power track disposed above the free track. These suspension systems have reached a high degree of sophistication and can include features such as the ability to stop and accumulate free trolleys in specific accumulating areas and transfer zones which include intersections where loads can be transferred between non-synchronous conveyor systems.

More recently, in response to the specific requirements of the automobile industry, floor mounted or "inverted" power and free systems have been developed. In these inverted systems, the power track and the free track are disposed beneath the floor of the factory, with the free track positioned above the power track. A plurality of trolleys operate within the free track, with certain of the trolleys being drive trolleys. Each drive trolley is connected to a load carriage. Such load carriages often include support wheels which roll along the factory floor to provide additional support and stability to the carriage. These are generally known as "dolly-type" carriers.

These inverted systems have the capability of handling bulkier and heavier loads, such as automobile chassis, while minimizing many dangerous conditions found in suspension systems. For example, inverted systems allow workers to safely climb on and off of the load carriages and they eliminate the danger inherent in the swinging loads of suspension systems.

At the same time, the development of inverted systems has presented a new and unique series of problems to designers. In a large factory, a single power and free conveyor can run for a mile or more. Within the length of the conveyor are a myriad of different assembly stations, many of which operate at different speeds, and thus require different drive chains. A longstanding problem in the design of power and free conveyors is the selective switching of the path of drive trolleys and their connected load carriages between, for example, an active conveyor loop and an accumulating conveyor loop.

Normally such switching is done via a pneumatically operated switch which swings a diverter between two positions. In a first diverter position, trolleys operating within the approaching active conveyor free track loop are allowed to continue on the same free track loop through the switch, thus remaining on the active conveyor. In the second position, the diverter deflects a trolley from the active conveyor free track loop onto the accumulating conveyor free track loop where it is engaged by drive members in the accumulating conveyor power track. When the drive trolley is diverted onto the accumulating conveyor, the towed dolly-type carrier is also diverted. However, as the active conveyor loop and the accumulating conveyor loop diverge (or converge) near the switch, the slots which extend through the factory floor in the active conveyor and the accumulating conveyor also diverge (or converge). This presents a problem, as the support wheels on one side of a passing dolly-type carriage must cross over the slot of the diverging (or converging), non-switched conveyor. The conveyor slots represent a substantial obstacle to the passage of the dolly-type carriage. At best, passage of the wheels of heavy load carriages over the slots, which are generally sealed with a resilient seal, causes the seal to be rapidly degraded, and jostles the load carriage, and the load it is carrying. At worst, the load carriage or the load can be upset as the carriage wheels encounter the slot.

It is clear then, that a need exists for a crossover seal selectively sealing the slot in one of two conveyor loops of a power and free conveyor as they diverge (or converge) near a switch. The crossover seal should automatically seal a crossover portion of a slot in the non-switched conveyor loop to allow dolly-type load carriages to traverse the switch without their wheels hitting the conveyor slot of the diverging (or converging), non-switched conveyor loop.

SUMMARY OF THE INVENTION

The present invention is directed to a seal crossover which includes two seal plates in separate respective conveyor loops as they diverge (or converge) near a switch in a power and free conveyor system. Each seal plate is driven by a respective dual acting pneumatic cylinder. The respective seal plate cylinders are in series, pneumatically, with a pneumatic cylinder driving the conveyor switch except that the seal plate cylinders are logically reversed. In other words, as the switch cylinder is operated to place the switch in either position, one seal plate cylinder is driven to close its seal plate while the other seal plate cylinder is driven to open its seal plate.

In the power and free conveyor system, a power and a free track are vertically aligned with one another. An endless drive chain operates within the power track, with a plurality of pusher members attached to the chain and extending toward the free track. Disposed for movement along the free track is a drive trolley conventionally supported by two pairs of wheels operating within a pair of opposed U shaped channels forming the free track. The drive trolley pulls or otherwise propels a dolly-type load carriage, which trails behind the drive trolley. In the conveyor system, at least one switch is provided at which drive trolleys and connected load carriages are selectively diverted from one conveyor loop to another. For example, an active conveyor loop and an accumulating conveyor loop may exist side-by-side such that trolleys and load carriages can be selectively accumulated in the accumulating conveyor to provide a buffer for a manufacturing section. Near the switch, a pair of pneumatically operated seal crossover assemblies are provided which selectively seal a crossover portion of a slot of the non-switched one of either the active conveyor loop or the accumulating conveyor loop. The seal crossover assemblies provide a temporary platform over which wheels on a dolly-type load carriage transiting the switch will roll to prevent the carriage wheels from hitting the respective conveyor slot on the diverging, non-switched conveyor.

OBJECTS AND ADVANTAGES OF THE INVENTION

The principal objects of the present invention are: to provide an improved automatic seal crossover system for power and free conveyor on-floor carriages; to provide such a seal crossover system near a conveyor switch which selectively switches drive trolleys and propelled load carriages between adjacent conveyor loops; to provide such a seal crossover which selectively switches one of a pair of seal plates over a respective conveyor slot in a non-switched conveyor loop while removing the other of the seal plates from a respective conveyor slot of the switched conveyor loop to allow unimpeded passage of an on-floor carriage; to provide such a seal crossover in which the seal plates are operated by respective double acting pneumatic cylinders which are placed in series with a pneumatic cylinder operating the conveyor switch, but with opposite logic; and to provide such a seal crossover which is reliable and efficient and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Power and Free Conveyor System

Figure 1:
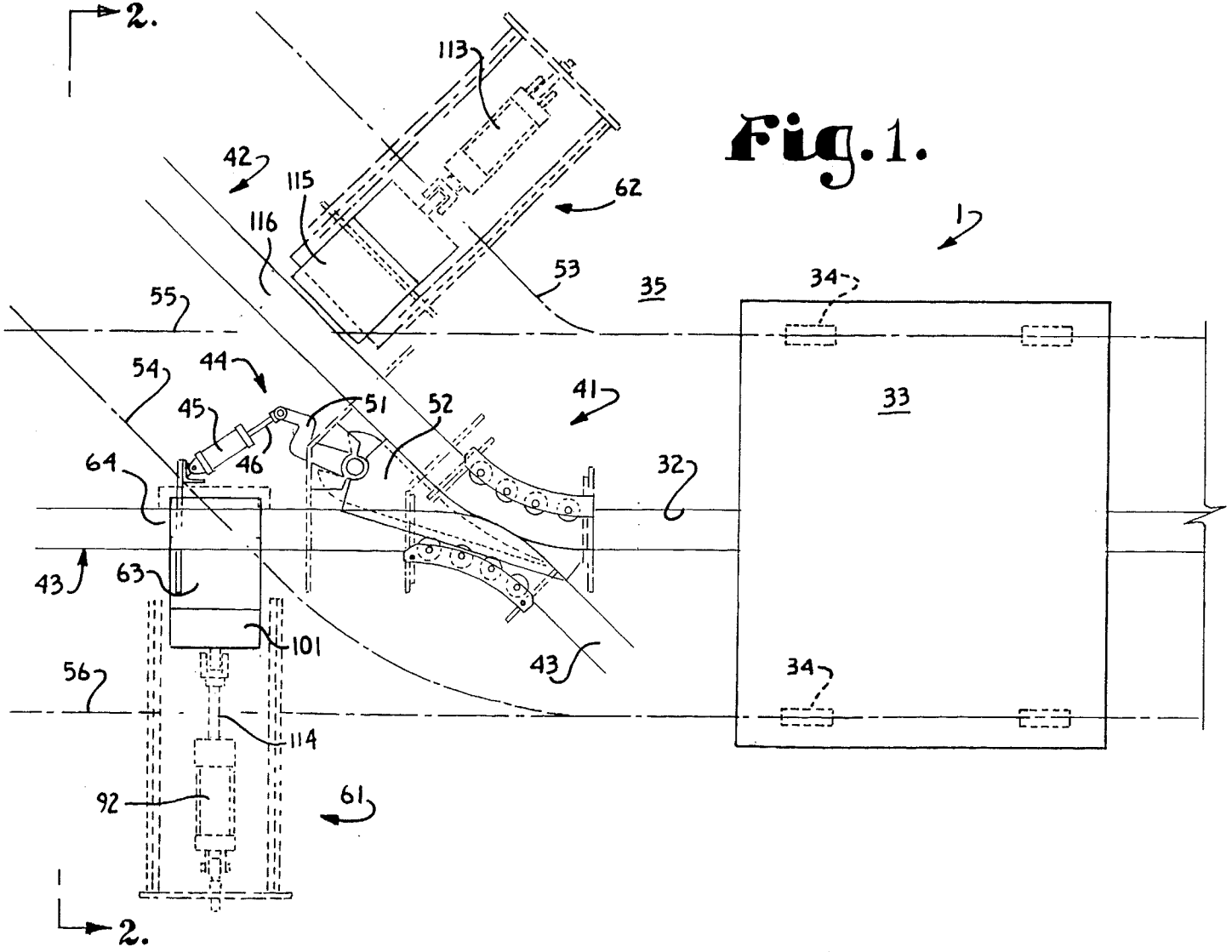
FIG. 1 is a simplified top plan view of a portion of a power and free conveyor system in which an on-floor dolly-type load carriage is transiting a conveyor switch equipped with a seal crossover system in accordance with the present invention, shown largely in phantom lines.
Figure 2:
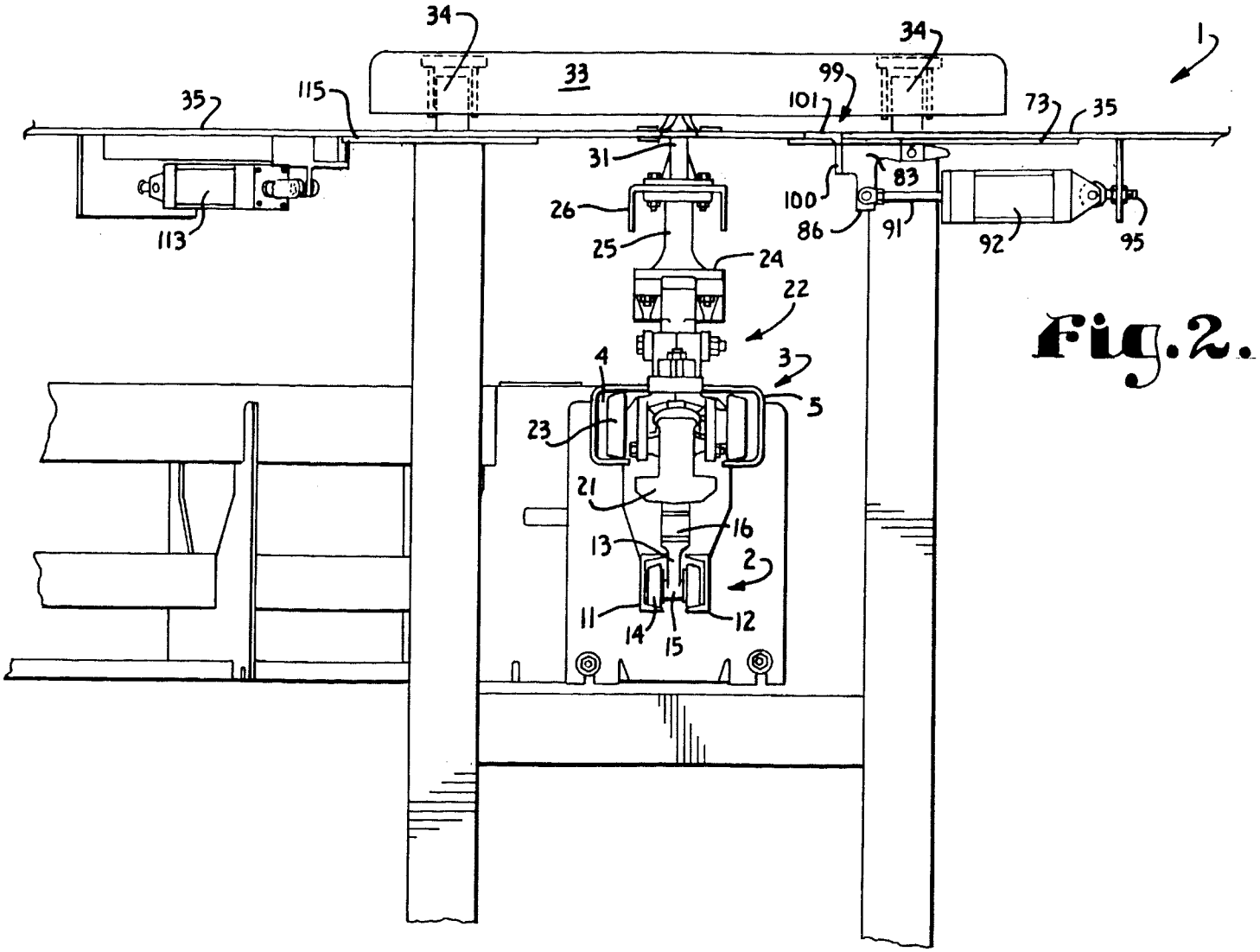
FIG. 2 is an enlarged, cross-sectional view of the conveyor switch and seal crossover system, taken along line 2—2 of FIG. 1, illustrating a drive trolley connected to the load carriage and with switch details omitted.

Referring to FIGS. 1 and 2, the reference numeral 1 generally indicates a power and free conveyor system in accordance with the present invention. The conveyor system 1 is of the inverted type in which a power track 2 is positioned beneath and vertically aligned with a free track 3. The free track 3 is formed by a pair of opposed U shaped channel members 4 and 5 and the power track 2 is also formed by a pair of smaller opposed U shaped channel members 11 and 12. An endless drive chain 13 is positioned within the power track 3 with a plurality of paired guide rollers 14 attached to respective axles 15 guiding the chain 13 within the channel members 11 and 12. A plurality of pusher members 16 are attached to the chain 13 at periodic intervals and extend upward therefrom toward the free track 3.

The pusher members 16 selectively engage retractable drive dogs 21 on respective drive trolleys, such as the drive trolley 22. As a pusher member 16 engages a drive dog 21, the chain 13 pushes the drive trolley 22 in the direction of movement of the chain 13. The drive trolley 22 has support wheels 23 operating within the free track 3, and also comprises a vertically oriented assembly 24. The assembly 24 includes a first vertical column 25 supporting a bracket 26. A second vertical bracket 31 extends upward from the bracket 26, through a conveyor slot 32, and is attached to a dolly-type load carriage 33. Thus, the load carriage 33 is constrained to move along with the drive trolley 22.

The load carriage 33 includes two pairs of support wheels or casters 34 which roll along a factory floor 35 to provide stability and support for the load carriage 33 and any load (not shown) carried thereon.

Referring to FIG. 1, a conveyor switch is generally indicated at 41. The switch 41 is an intersection between a first power and free conveyor loop 42 and a second power and free conveyor loop 43. A conveyor switch assembly 44 includes a double acting pneumatic switch cylinder 45 with a retractable arm 46 connected to a bell crank 51. The bell crank 51 is connected to and controls the position of a diverter 52. The diverter 52, in the position shown, directs the drive trolley 22 (FIG. 2) to remain on a path with the first conveyor loop 42 as it curves to the right through the switch 41. In a second position (not shown), when the arm 46 is withdrawn, the diverter 52 is positioned to allow the drive trolley 22 to switch paths from the first conveyor loop 42 to the second conveyor loop 43, i.e. the drive trolley 22 and the dolly 33 continue on a straight line through the switch. The load carriage dolly wheels 34 follow respective wheel paths 53 and 54 (wheel paths are indicated in broken lines) when the drive trolley 22 stays on the curved path of the first conveyor loop 42. The dolly wheels 34 follow the wheel paths 55 and 56 when the drive trolley 22 is switched to the straight path of the conveyor loop 43. The switch 41 is conventional, and therefore, no detailed illustrations have been provided therefor. Details of the switch assembly 44 have been omitted from FIG. 2 for simplification.

A crossover seal system in accordance with the present invention includes a first crossover seal plate assembly 61 and a second crossover seal plate assembly 62. Since the seal plate assemblies 61 and 62 are identical, only the seal plate assembly 61 will be described in detail herein.

Figure 3:
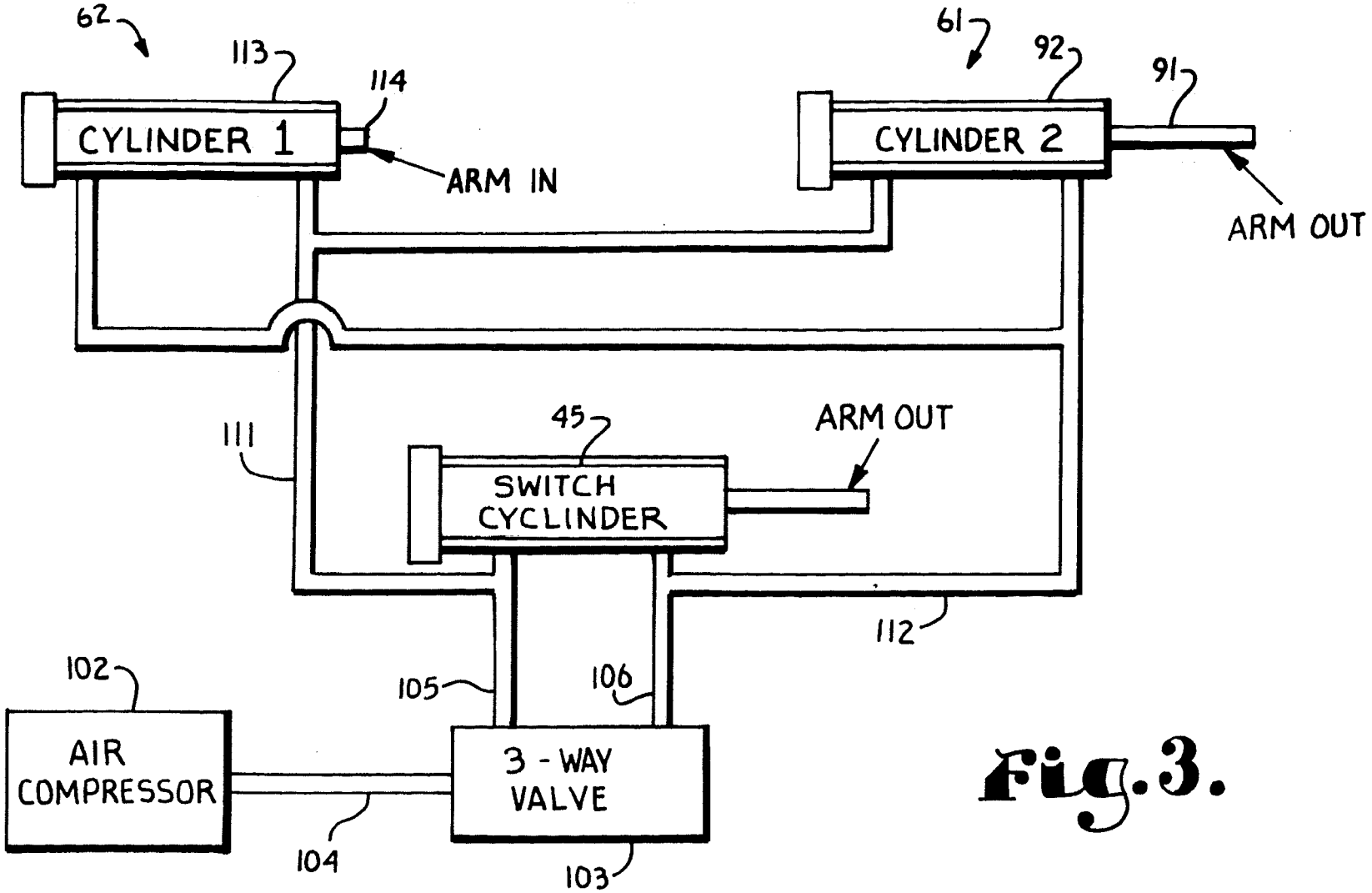
FIG. 3 is a enlarged, cross-sectional view of a seal crossover assembly, taken along line 3—3 of FIG. 1, and illustrating a side elevational view of a seal plate and seal plate cylinder in a slot opening position.
Figure 5:
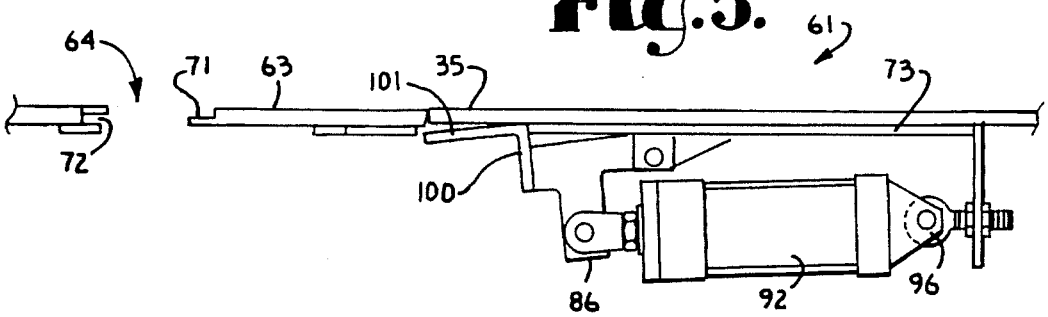
FIG. 5 is an enlarged, cross-sectional view of the seal crossover assembly, taken along line 5—5 of FIG. 4, and illustrating a top plan view of a seal in a slot closing position.
Figure 4:
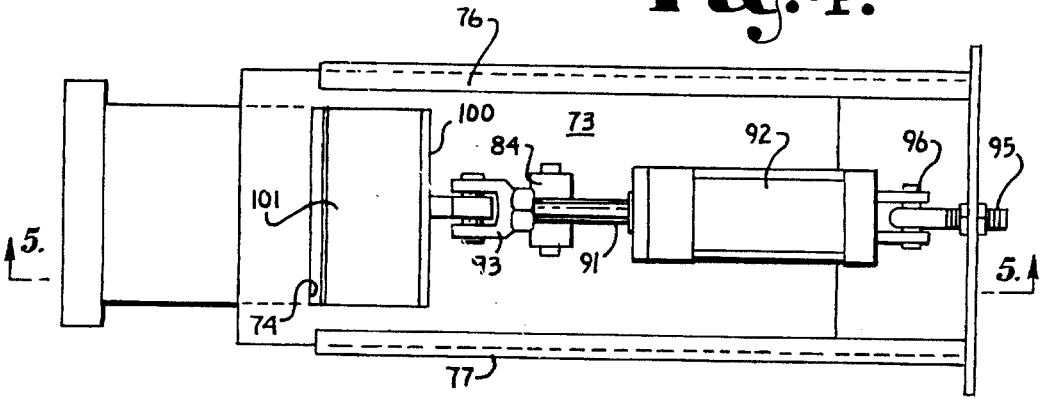
FIG. 4 is a enlarged, cross-sectional view of a seal crossover assembly, taken along line 4—4 of FIG. 1, and illustrating a side elevational view of a seal plate and a seal plate cylinder in a slot closing position.

Referring to FIGS. 3–5, the seal plate assembly 61 includes a seal plate 63 positioned adjacent to a crossover portion 64 of the conveyor slot 32 in the factory floor 35. The seal plate 63 includes a tongue portion 71 which interlocks with a mating groove 72 in the edge of the floor 35. The seal plate 63 is welded, or otherwise rigidly attached, to a sliding plate 73 extending beneath the floor 35. The sliding plate 73 includes an opening 74 which is the same length as the seal plate 63 and which is approximately the same width as the crossover slot portion 64. The opening 74 is sized and positioned to be beneath a gap 75 between the floor 35 and the seal plate 63 which is opened when the seal plate 63 is closed.

The sliding plate 73 is supported by and is movable longitudinally relative to a pair of angle members 76 and 77. The sliding plate 73 is attached to a first leg 82 of a pivot block 83 via a pivot mount 84. The leg 82 is tapered at a remote end 85. A second leg 86 of the pivot block 83 is connected to a piston arm 91 of a double acting pneumatic cylinder 92 via a clevis 93. The pneumatic cylinder 92 is pivotably attached to a support member 94 via an eye bolt 95 and a second clevis 96. An L-shaped (in cross-section) gap plate 99 has a first leg 100 connected to the pivot block 83. The gap plate 99 has a second leg 101 with dimensions slightly less than the length and the width of the opening 74 in the sliding plate 73. The gap plate 99 is thus also pushed to the left with the sliding plate 73 and is simultaneously pivoted upward with the pivot block 83 as the gap 75 is opened to thereby fill the gap 75 vacated by the seal plate 63 with the leg 101. As the crossover seal cylinder 92 is retracted, the gap plate 101 is pivoted downward with the pivot block 83 and is simultaneously retracted back to the position shown in FIG. 3 as the seal plate 63 is retracted to the position of FIG. 3, again closing the gap 75. The tapered end of the pivot block 83 acts to prevent the pivot block 83 and the connected gap plate 99 from pivoting more than necessary as the piston arm 91 is retracted.

Figure 6:
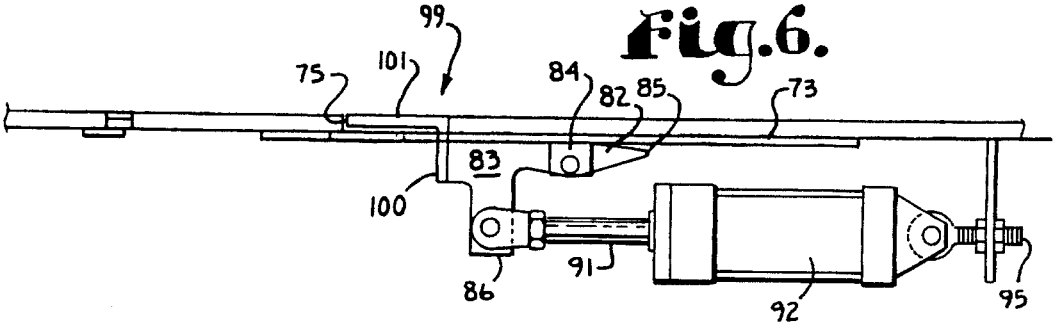
FIG. 6 is a schematic pneumatic diagram for the conveyor switch and seal crossover of FIG. 1.

FIG. 6 illustrates a pneumatic schematic diagram for the conveyor switch cylinder 45 and the crossover seal assemblies 61 and 62. An air compressor 102 is connected to a 3-way valve 103 via a pneumatic line 104. Leading from the valve 103 to the switch cylinder 45 are a pair of pneumatic lines 105 and 106. As illustrated in FIG. 1, when the valve 103 is operated to supply pressurized air to the line 105, the arm 46 is extended, thus switching the conveyor switch diverter 52 to cause the drive trolley 22 and the load carriage 33 to remain on the curved path of the conveyor loop 42. By contrast, when the valve 103 is operated to supply compressed air to the line 106, the switch cylinder arm 46 is retracted, thus switching the conveyor switch diverter 52 to cause the drive trolley 22 and a driven load carriage 33 to continue on a straight path by switching to the conveyor loop 43.

An additional pair of pneumatic lines 111 and 112 are connected in series with the lines 105 and 106, respectively. The crossover seal plate cylinder 92 of the seal plate assembly 61 is attached to the lines 111 and 112 such that the cylinder arm 91 is extended and retracted in synchronism with the switch cylinder arm 46. By contrast, in the seal crossover assembly 62, a crossover seal plate cylinder 113 is attached to the lines 111 and 112 such that a cylinder arm 114 is extended and retracted opposite to the switch cylinder arm 46.

Thus, referring to FIGS. 1–6, as the conveyor switch 41 is switched to the position shown, i.e. such that the drive trolley 22 will remain on the curved path of the conveyor loop 42, the seal crossover assembly 61 will operate such that the seal plate 63 is extended to close the slot crossover portion 64 of the non-switched conveyor loop 43. Referring to FIGS. 3–5, this is done by extending the arm 91 to push the sliding plate 73 to the left, as illustrated. Thus, the seal plate 63 is pushed to the left as well, covering the slot crossover portion 64. As the seal plate 63 moves to the left, the gap plate 99 pivots upward to fill the gap 75 vacated by the seal plate 63. This permits the wheels 34 of the carriage 33 to pass unimpeded over the slot crossover portion 64 of the conveyor loop 43. At the same time, in the seal crossover assembly 62, the cylinder 113 retracts the arm 114, thus retracting a seal plate 115 from a slot crossover portion 116 of the switched conveyor loop 42. This permits the vertical member 31 of the drive trolley 22 to pass through the slot crossover portion 116 of the conveyor loop 42.

As the conveyor switch 41 is switched to the opposite position (not shown), due to the pneumatic connections between the seal crossover cylinders 92 and 113 and the switch cylinder 45, the seal crossover assemblies 61 and 62 reverse their positions such that the slot crossover portion 64 of the switched conveyor loop 43 would be opened while the slot crossover portion 116 of the non-switched conveyor loop 42 would be closed.

Although the system has been illustrated as using pneumatic cylinders 45, 92 and 116, the switch 41 and the seal crossover assemblies 61 and 62 could be operated hydraulically as well. Furthermore, the switch 41 is for illustration purposes only and is but one of several different switch orientations typically found in inverted power and free conveyor systems. Thus, the inventive seal crossover system can be readily adapted to other switch configurations, regardless whether the conveyor loops are diverging or converging near the switch. It is thus to be understood that while certain forms of the present invention have been illustrated and described herein, it is not to be limited to the specific forms or arrangement of parts described and shown.

What is claimed and desired to be secured by Letters Patent is as follows:

1. In a power and free conveyor system comprising first and second power and free conveyor loops; a conveyor switch with a first switch position in which a drive trolley stays on a path which follows a free track of said first conveyor loop and a second switch position in which a drive trolley switches from said first conveyor loop to a path within a free track of a second conveyor loop; each of said first and second conveyor loops being positioned beneath a floor and including a slot extending through the floor which follows the path of the respective conveyor loop, said first and second conveyor loops and said slots diverging on at least one side of said conveyor switch; said drive trolley propelling a load carriage with wheels which roll on said floor, said wheels being positioned such that, when the drive trolley is switched onto the first conveyor loop, at least some load carriage wheels encounter a crossover portion of the slot of the second conveyor loop and, when the drive trolley is switched onto the second conveyor loop, at least some of the load carriage wheels encounter a crossover portion of the slot of the first conveyor loop; a crossover seal system comprising:

a. a first crossover seal assembly which is operative to place a first seal plate over the crossover portion of the first conveyor loop slot when said conveyor switch is in the first position; and b. a second crossover seal assembly for placing a second seal plate over the crossover portion of the second conveyor loop slot when said conveyor switch is in said second position, said first and second seal plates being independent of each other and being independently operated by said first and second crossover seal assemblies, respectively.

2. A crossover seal system as in claim 1, wherein each of said first and second crossover seal assemblies includes:

a. a double acting cylinder with an arm which is selectively extendable and retractable; and b. the respective first or second seal plate being connected to the arm and positioned such that, when said arm is extended, said seal plate extends across the crossover portion of the respective conveyor slot to provide support for the carriage wheels as said carriage crosses the crossover portion of the respective conveyor slot and, when said arm is retracted, said seal plate is retracted from across said respective conveyor slot.

3. A crossover seal system as in claim 2, wherein said conveyor switch includes a double acting switch cylinder for selectively switching said switch between said first and second switch positions and wherein:

a. the double acting cylinder in said first crossover seal assembly is connected in series with the switch cylinder such that it operates in synchronism with said switch cylinder; and b. the double acting cylinder in said second crossover seal assembly is connected in series with the switch cylinder such that it operates opposite to the switch cylinder.

4. A crossover seal system as in claim 3, wherein the double acting switch cylinder and the cylinders in said crossover seal assemblies are pneumatically actuated, said cylinders in said crossover seal assemblies being connected in series pneumatically with said switch cylinder.

5. A crossover seal system as in claim 2, wherein, when one of said seal plates is extended across the respective conveyor slot crossover portion, a gap is left in said floor in the area vacated by said seal plate, and wherein each of said first and second crossover seal assemblies further includes a pivotable gap plate which is moved into said gap in the floor as said arm is extended.

6. A crossover seal system as in claim 2, wherein an edge of the floor on at least one side of each conveyor slot at said slot crossover portion has a groove which interlocks with a tongue of said seal plate when said seal plate is extended across said slot crossover portion.

7. A crossover seal system as in claim 2, wherein, when one of said seal plates is extended across the respective conveyor slot crossover portion, a gap is left in said floor in the area vacated by said seal plate, each said crossover seal assembly further comprising:

a. a pivot block with a pair of legs, a first one of said legs being pivotably connected to said arm;

b. a slide plate positioned beneath said floor and being attached to said seal plate and to the second of said pair of legs of said pivot block such that said pivot block can pivot relative to said slide plate, said slide plate having a gap formed therein; and c. a gap plate attached to said pivot block such that, as said arm is extended, said seal plate is moved into the crossover portion of said conveyor slot and said gap plate is moved and simultaneously pivoted upward through said slide plate gap and into the floor gap vacated by said seal plate.

8. In a power and free conveyor system comprising first and second power and free conveyor loops; a conveyor switch with a first switch position in which a drive trolley stays on a path which follows a free track of said first conveyor loop and a second switch position in which a drive trolley switches from said first conveyor loop to a path within a free track of a second conveyor loop; each of said first and second conveyor loops being positioned beneath a floor and including a slot extending through the floor which follows the path of the respective conveyor loop, said first and second conveyor loops and said slots diverging on at least one side of said conveyor switch; said drive trolley propelling a load carriage with wheels which roll on said floor, said wheels being positioned such that, when the drive trolley is switched onto the first conveyor loop, at least some load carriage wheels encounter a crossover portion of the slot of the second conveyor loop and, when the drive trolley is switched onto the second conveyor loop, at least some of the load carriage wheels encounter a crossover portion of the slot of the first conveyor loop; a crossover seal system comprising:

a. a first crossover seal assembly which is operative to place a seal plate over the crossover portion of the first conveyor loop slot when said conveyor switch is in the first position;

b. a second crossover seal assembly for placing a seal plate over the crossover portion of the second conveyor loop slot when said conveyor switch is in said second position; and wherein each of said crossover seal assemblies comprises:

i. a double acting cylinder with an arm which is selectively extendable and retractable; and ii. a seal plate connected to the arm and positioned such that, when said arm is extended, said seal plate extends across the crossover portion of the respective conveyor slot to provide support for the carriage wheels as said carriage crosses the crossover portion of the respective conveyor slot and, when said arm is retracted, said seal plate is retracted from across said respective conveyor slot.

9. A crossover seal system as in claim 8, wherein said conveyor switch includes a double acting switch cylinder for selectively switching said switch between said first and second switch positions and wherein:

a. the double acting cylinder in said first crossover seal assembly is connected in series with the switch cylinder such that it operates in synchronism with said switch cylinder; and b. the double acting cylinder in said second crossover seal assembly is connected in series with the switch cylinder such that it operates opposite to the switch cylinder.

10. A crossover seal system as in claim 9, wherein the double acting switch cylinder and the cylinders in said crossover seal assemblies are pneumatically actuated, said cylinders in said crossover seal assemblies being connected in series pneumatically with said switch cylinder.

11. A crossover seal system as in claim 8, wherein, when one of said seal plates is extended across the respective conveyor slot crossover portion, a gap is left in said floor in the area vacated by said seal plate, and wherein each of said first and second crossover seal assemblies further includes a pivotable gap plate which is moved into said gap in the floor as said arm is extended.

12. A crossover seal system as in claim 8, wherein an edge of the floor on at least one side of each conveyor slot at said slot crossover portion has a groove which interlocks with a tongue of said seal plate when said seal plate is extended across said slot crossover portion.

13. A crossover seal system as in claim 8, wherein, when one of said seal plates is extended across the respective conveyor slot crossover portion, a gap is left in said floor in the area vacated by said seal plate, each said crossover seal assembly further comprising:

a. a pivot block with a pair of legs, a first one of said legs being pivotably connected to said arm;

b. a slide plate positioned beneath said floor and being attached to said seal plate and to the second of said pair of legs of said pivot block such that said pivot block can pivot relative to said slide plate, said slide plate having a gap formed therein; and c. a gap plate attached to said pivot block such that, as said arm is extended, said seal plate is moved into the crossover portion of said conveyor slot and said gap plate is moved and simultaneously pivoted upward through said slide plate gap and into the floor gap vacated by said seal plate.

14. In a crossover seal system for a power and free conveyor system comprising first and second power and free conveyor loops; a conveyor switch with a first switch position in which a drive trolley stays on a path which follows a free track of said first conveyor loop and a second switch position in which a drive trolley switches from said first conveyor loop to a path within a free track of a second conveyor loop, said conveyor switch including a double acting switch cylinder for selectively switching said switch between said first and second switch positions, each of said first and second conveyor loops being positioned beneath a floor and including a slot extending through the floor which follows the path of the respective conveyor loop, said first and second conveyor loops and said slots diverging on at least one side of said conveyor switch; said drive trolley propelling a load carriage with wheels which roll on said floor, said wheels being positioned such that, when the drive trolley is switched onto the first conveyor loop, at least some load carriage wheels encounter a crossover portion of the slot of the second conveyor loop and, when the drive trolley is switched onto the second conveyor loop, at least some of the load carriage wheels encounter a crossover portion of the slot of the first conveyor loop; a crossover seal assembly comprising:

a. a double acting cylinder with an arm which is selectively extendable and retractable, said double acting cylinder in said crossover seal assembly being connected in series with the switch cylinder; and b. a seal plate connected to the arm and positioned such that, when said arm is extended, said seal plate extends across the crossover portion of the respective conveyor slot to provide support for the carriage wheels as said carriage crosses the crossover portion of the respective conveyor slot and, when said arm is retracted, said seal plate is retracted from across said respective conveyor slot.

15. A crossover seal assembly as in claim 14, wherein the double acting switch cylinder and the cylinders in said crossover seal assembly are pneumatically actuated, said cylinders in said crossover seal assembly being connected in series pneumatically with said switch cylinder.

16. A crossover seal assembly as in claim 14, wherein, when one of said seal plates is extended across the respective conveyor slot crossover portion, a gap is left in said floor in the area vacated by said seal plate, said crossover seal assembly further comprising:

a. a pivot block with a pair of legs, a first one of said legs being pivotably connected to said arm;

b. a slide plate positioned beneath said floor and being attached to said seal plate and to the second of said pair of legs of said pivot block such that said pivot block can pivot relative to said slide plate, said slide plate having a gap formed therein; and c. a gap plate attached to said pivot block such that, as said arm is extended, said seal plate is moved into the crossover portion of said conveyor slot and said gap plate is moved and simultaneously pivoted upward through said slide plate gap and into the floor gap vacated by said seal plate.

* * * * *